US008512454B2

(12) United States Patent
Gibis et al.

(10) Patent No.: US 8,512,454 B2
(45) Date of Patent: Aug. 20, 2013

(54) ELECTROSTATIC DUST CATCHER

(75) Inventors: Karl-Ludwig Gibis, Limburgerhof (DE); Mike Kosub, Bruchsal (DE)

(73) Assignee: Carl Freudenberg KG, Weinheim (DE)

( * ) Notice: Subject to any disclaimer, the term of this patent is extended or adjusted under 35 U.S.C. 154(b) by 354 days.

(21) Appl. No.: 12/867,222

(22) PCT Filed: Nov. 13, 2008

(86) PCT No.: PCT/EP2008/009569

§ 371 (c)(1), (2), (4) Date: Aug. 11, 2010

(87) PCT Pub. No.: WO2009/100744

PCT Pub. Date: Aug. 20, 2009

(65) Prior Publication Data

US 2010/0307342 A1 Dec. 9, 2010

(30) Foreign Application Priority Data

Feb. 11, 2008 (DE) ..... 10 2008 008 576

(51) Int. Cl.
*B03C 3/10* (2006.01)

(52) U.S. Cl.
USPC ..... 96/30; 15/1.52; 55/378; 96/39; 96/66; 96/80; 96/83; 96/94

(58) Field of Classification Search
USPC ..... 96/30, 39, 40, 83, 94, 66, 80; 15/1.51, 15/1.52; 55/361, 378
See application file for complete search history.

(56) References Cited

U.S. PATENT DOCUMENTS

| | | | | |
|---|---|---|---|---|
| 5,957,090 | A * | 9/1999 | Larson | 119/600 |
| 6,243,909 | B1 * | 6/2001 | Graham et al. | 15/228 |
| 6,260,224 | B1 | 7/2001 | Pinkus | |
| 2004/0016066 | A1 * | 1/2004 | Frazier et al. | 15/1.52 |
| 2004/0130894 | A1 | 7/2004 | Galli | |
| 2004/0163667 | A1 | 8/2004 | Learman | |
| 2006/0064826 | A1 * | 3/2006 | Kimball | 15/1.52 |
| 2006/0137116 | A1 * | 6/2006 | Tsuchiya et al. | 15/1.52 |
| 2007/0039832 | A1 | 2/2007 | Heikenfeld | |
| 2008/0087297 | A1 * | 4/2008 | Rahbar-Dehghan | 134/1 |

FOREIGN PATENT DOCUMENTS

| | | | | |
|---|---|---|---|---|
| BE | 901726 | A1 | 5/1985 | |
| DE | 202005019251 | U1 | 3/2006 | |
| DE | 202006006939 | U1 | 6/2006 | |
| DE | 102005025101 | B3 | 7/2006 | |
| JP | 4-84926 | A * | 3/1992 | 15/1.52 |
| JP | 05-285084 | | 2/1995 | |
| JP | 9-131290 | | 5/1997 | |
| WO | WO 2007/022311 | A2 | 2/2007 | |

* cited by examiner

*Primary Examiner* — Richard L Chiesa
(74) *Attorney, Agent, or Firm* — Leydig, Voit & Mayer, Ltd.

(57) ABSTRACT

The invention relates to electrostatic dust catcher including a first (1) and a second electrode (2) and a voltage source (3) for applying an electrical voltage between the two electrodes (1, 2). The first electrode (1) is designed as a dust catching device and the second electrode (2) is grounded.

14 Claims, 4 Drawing Sheets

ELECTROSTATIC DUST CATCHER

FIELD OF THE INVENTION

The invention concerns an electrostatic dust catcher, comprising a first and a second electrode and a voltage source for the application of a voltage between the two electrodes.

BACKGROUND OF THE INVENTION

An electrostatic dust catcher is known from US 2004/0163667 A1. The previously known dust catcher is designed as a floor cleaning device and has a grid-shaped mat, wherein the two electrodes are components of the mat. The mat can be covered, for example, by a cleaning cloth. The voltage source is a battery, which is located, for example, in the manual handle, wherein the starting voltage is converted into a high voltage. The area between the electrodes is electrically charged, wherein the dust to be taken up has an opposite polarity, with reference to the electrodes, and in this way, is attracted. Also disclosed is a charging station for the dust catcher, if the voltage source comprises a storage battery, instead of a battery. Furthermore, the previously known dust catcher can have motion detectors.

Due to the arrangement of the two electrodes in the grid-shaped mat, the previously known dust catcher has the disadvantage that the highest field line density of the electrical field, and thus, the greatest polarization effect, is limited to the space between the two electrodes. As a result of the flat arrangement of the two electrodes, no significant force appears on particles outside the electrodes. The particles must first arrive here in the space between the electrodes, so as to then polarize to a sufficient extent and then be attracted by an electrode.

Such electrode configurations and geometries are not able to attract dust particles over a distance of several millimeters or even centimeters by means of electrostatic forces. A covering of the electrodes, with a textile even, completely prevents the possibility for the particles to arrive in the area of the greatest electrical field strength between the electrodes and further reduces the performance capacity of the previously known device.

BRIEF SUMMARY OF THE INVENTION

An object of the invention is to avoid the aforementioned disadvantages, with the dust catcher of the invention having a good effectiveness and manageability when it is used properly, while utilizing a very simple electrode configuration. Furthermore, it should be possible to produce the dust catcher in a simple and low-cost manner.

To attain the goal, an electrostatic dust catcher is provided, in which the first electrode is designed as a dust-collecting device and the second electrode is grounded. The second electrode can be grounded, whether directly via an electrically conducting floor contact (for example, for floor cleaning devices) or via the user and a manual handle designed to be electrically conducting (for example, for dust-collecting manual devices). It is advantageous hereby that the dust catcher, in accordance with the invention, can be handled simply, as a whole, due to its simple electrode configuration, and can be produced at low cost. Due to the grounding of the counter-electrode, the maximum potential difference between the dust on the surface and the electrode directed at the dust is attained. The dust is thus found in the area of the greatest field line density and is thus exposed to the greatest polarization and attractive force.

The dust catcher, in accordance with the invention, is particularly suitable for the dry removal of dust on the usual household surfaces. The efficiency can be enhanced by the selection of suitable electrode materials and suitable electrode configurations for the optimization of the electrical field of the electrodes exposed to the dust.

The second electrode is preferably designed as a manual handle. The grounding of the counter-electrode via the user, through a handle which is connected, in a conductive manner, with the electrode, has the additional advantage that the user, independent of the operating conditions, is at ground potential and thus when in contact with the surroundings, no electrostatic discharge ("no electrical shock") occurs.

The voltage source can be accommodated in the framework containing the electrode in the embodiment, as a floor cleaning device; in manual devices, it can be placed in the manual handle. Usually, a manual handle defines a sufficiently large space, so as to hold the voltage source. The handling of such a dust catcher is particularly good, because its center of gravity is close to the body of the user and undesired lifting effects, such as, when using a very top-heavy cleaning device, can be avoided. Furthermore, the voltage source is well-protected from external influences by its placement in the manual handle. Such a dust catcher has good durability and simultaneously good reliability.

The voltage source comprises a battery with a starting voltage. A rechargeable storage battery can generally also be regarded as a battery. Furthermore, the voltage source comprises a charging unit with a voltage divider and a bridge rectifier for the conversion of the starting voltage to a high-frequency high voltage, wherein the high-frequency high voltage is converted by a rectifier into a static high voltage and is applied on a condenser with a preferably small capacity of, with particular preference, 1 nF. Generally, the condenser can have a capacity of 0.001-100 nF, preferably, 0.05-10 nF.

The starting voltage can be 1-10 V, preferably, 1.5-3 V. The static high voltage preferable can be 0.5-10 kV. Such a low starting voltage can be readily attained with commercial batteries/storage batteries, which are available at low cost, practically everywhere. This is a noteworthy advantage, especially in the area of low-cost consumer goods.

The static high voltage can be gradually or infinitely adjustable. The force of attraction which the electrodes exert on the dust to be taken up is dependent on the magnitude of the high voltage, wherein the magnitude of the high voltage is limited by the dielectric strength of the air. An adjustable high voltage is advantageous, particularly if it can be gradually adjusted, if the same dust catcher is to be used to hold various types of dusts and/or to hold dust under different ambient conditions, such as changing air humidity.

The dust catcher is site-independent and can be used in a freely movable manner as a result of the previously described voltage source.

The voltage source can be turned on or off by a charging unit. The manual handle can also have a discharge unit to discharge the electrical voltage between the electrodes. With regard to a simplified handling, the charging unit and the discharging unit can be comprised in a combination unit.

The electrodes can be made of the usual, suitable materials—for example, metal or polymeric materials.

The first electrode exposed to the dust can be covered, at least in part, by a dust cloth. It is, moreover, preferable for the first electrode to be enclosed by a bag-shaped dust cloth. Here, it is advantageous for the holding of the dust to take place not only contactless by the potential difference and the resulting force of attraction of the electrodes on the dust, but rather, also, by direct contact of the dust by the dust cloth. The cleaning performance improves particularly if the dust on the surfaces to be cleaned lies loosely in some cases and also adheres more intensely in other cases.

If a dust cloth consists, at least in part, of microfibers, it has particularly good usage characteristics.

Generally, the dust to be taken up can be taken up in various ways by the dust catcher.

The electrodes can be covered with a smooth, electrically nonconducting material, so that the dust is fixed by the electrostatic charge on this material. The dust is thereby attracted from the surfaces to be cleaned, by the device, over a distance of several centimeters, without thereby coming into contact with the dust. The attraction occurs by influence and/or polarization.

Influence is understood to mean, in this context, a charge shift in a conductor (for example, in a conductive dust particle) due to an external electrical field.

In contrast to this, polarization, in this context, is understood to mean that due to the application of an external electrical field (here, the electrode), a charge shift is produced in a nonconducting material (here, the dust particle). In this way, a temporary dipole in the particle is produced, on which a force acts in the electrical field.

Since to a large extent, house dust consists of textile fibers which have poor electrical conductivity, one deals here predominantly with the phenomenon of polarization, wherein the limits to the influence, affected by the ambient conditions, such as humidity, are fluid.

In contrast to this, the electrodes, however, can also be covered with a more or less, greatly structured, electrically nonconducting textile, such as a nonwoven, a woven fabric, a knitted fabric, or fibers, wherein the textile mechanically holds the dust due to its porous surface structure, in addition to the electrostatic effect. The dust can be taken up here either without direct contact of the textile with the surfaces to be cleaned, by the electrostatic attraction, or by a direct contact of the textile with the surfaces to be cleaned—that is, by a mechanical holding. The electrostatic effect is hereby intensified by the mechanical effect, which, in particular, with firmly adhering, already dust is advantageous. In another embodiment, the electrode can be covered with a smooth, nonconducting plastic material, such as, a plastic film, on which the dust particles are deposited. Such a film permits a subsequent removal of the dust by a simple scraping off, or after the discharging of the electrode, by simply knocking off the dust.

BRIEF DESCRIPTION OF THE DRAWINGS

Two embodiment examples of an electrostatic dust catcher, in accordance with the invention, are described, below, with the aid of the schematically depicted FIGS. 1-4. The figures show the following.

DETAILED DESCRIPTION OF THE INVENTION

Figure 1:
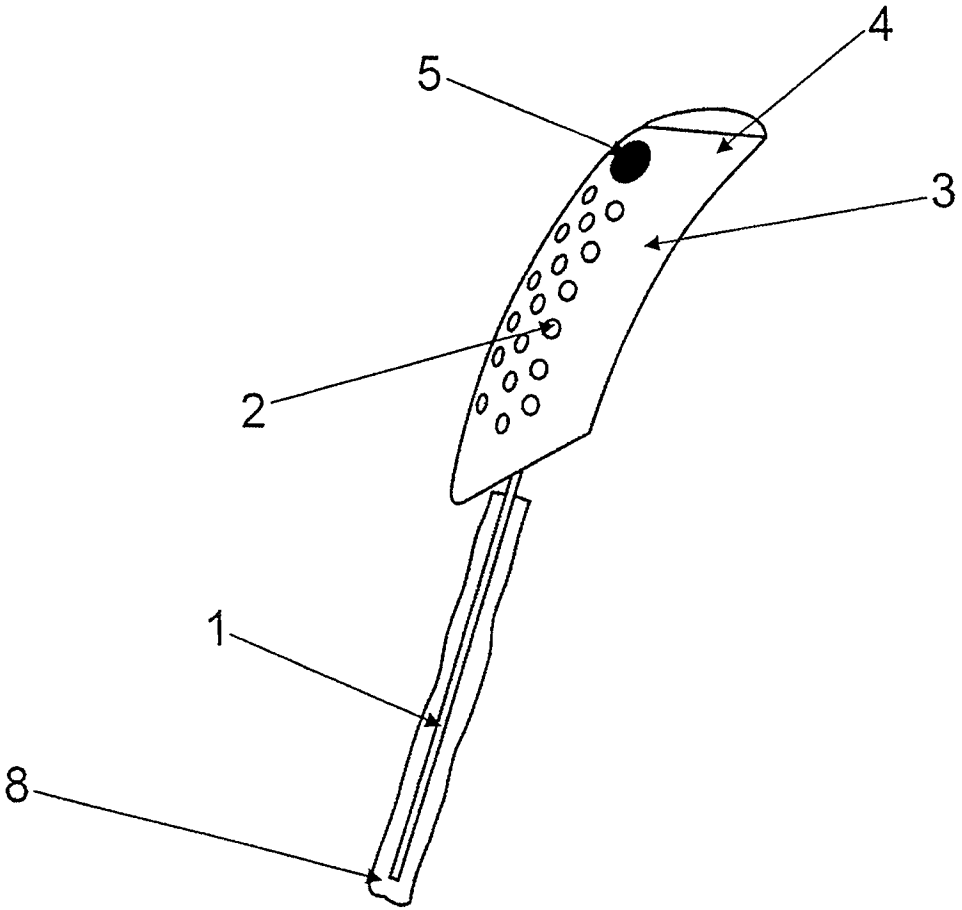
FIG. 1 is a side view of a first exemplary embodiment of a dust catcher according to the invention.

FIGS. 1-4 show two embodiment examples of an electrostatic dust catcher, each essentially consisting of a manual handle 4 and a dust-collecting device, which is affixed to the manual handle 4. The dust-collecting device is formed by the first electrode 1, which is completely enclosed in the illustrated embodiment by a bag-shaped dust cloth 8. The dust cloth 8 can consist of microfibers, partially or completely.

The manual handle 4 is formed by the second electrode 2. The voltage source 3 is located in and is protectively enclosed by the manual handle 4. The voltage source 3 is understood to be a battery or a rechargeable storage battery, within the framework of the invention, with a starting voltage and a switch with a voltage divider and a bridge rectifier to convert the starting voltage into a high-frequency high voltage. The high-frequency high voltage is converted, by a rectifier, into a static high voltage and is applied on a condenser. The starting voltage in this embodiment example is 1.5 V; the static high voltage is approximately 5 kV.

In order to guarantee an optimal taking up of the dust and to avoid a charge unpleasant for the user, the manual handle 4 is connected in a conducting manner with the electrode 2. The manual handle 4 is grounded. The second electrode 2 is connected to the ground by the user, so that a potential difference is produced between the two electrodes 1 and 2 and dust is drawn to the first electrode 1 by the electrostatic dust catcher.

Figure 2:
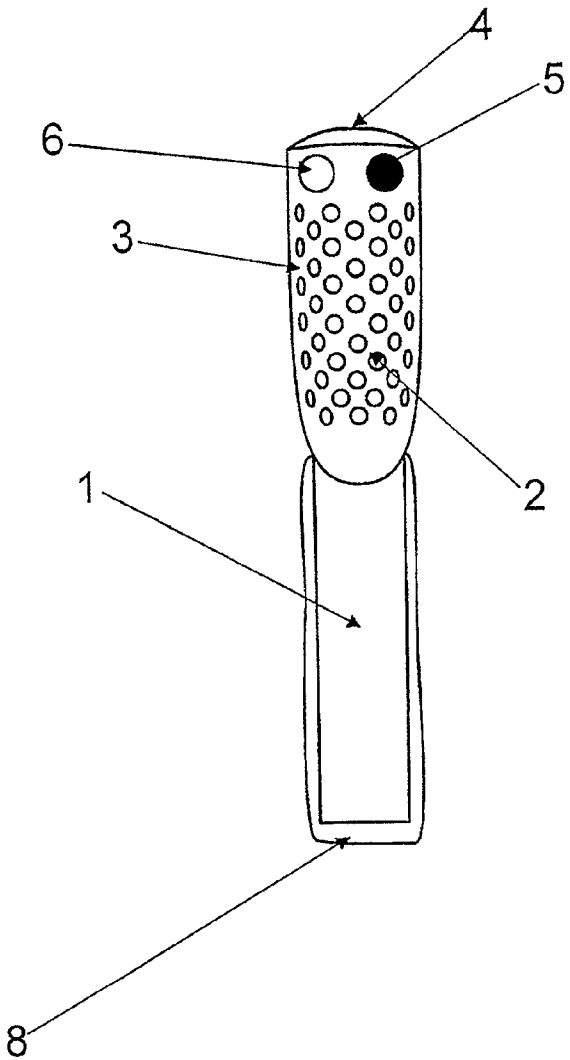
FIG. 2 is a front view of the dust catcher of FIG. 1.
Figure 3:
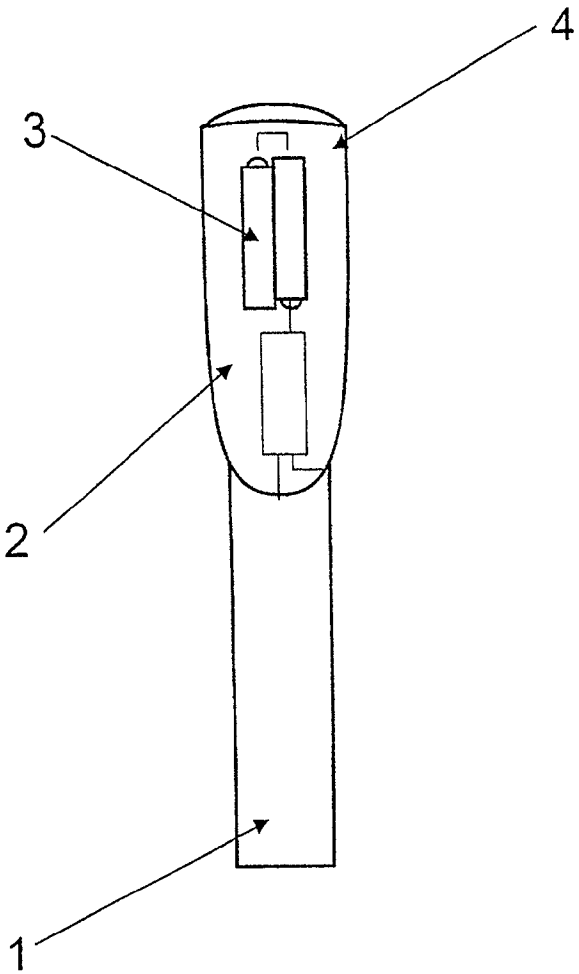
FIG. 3 is a partially cutaway view of the dust catcher of FIG. 1 showing the interior of the manual handle.
Figure 4:
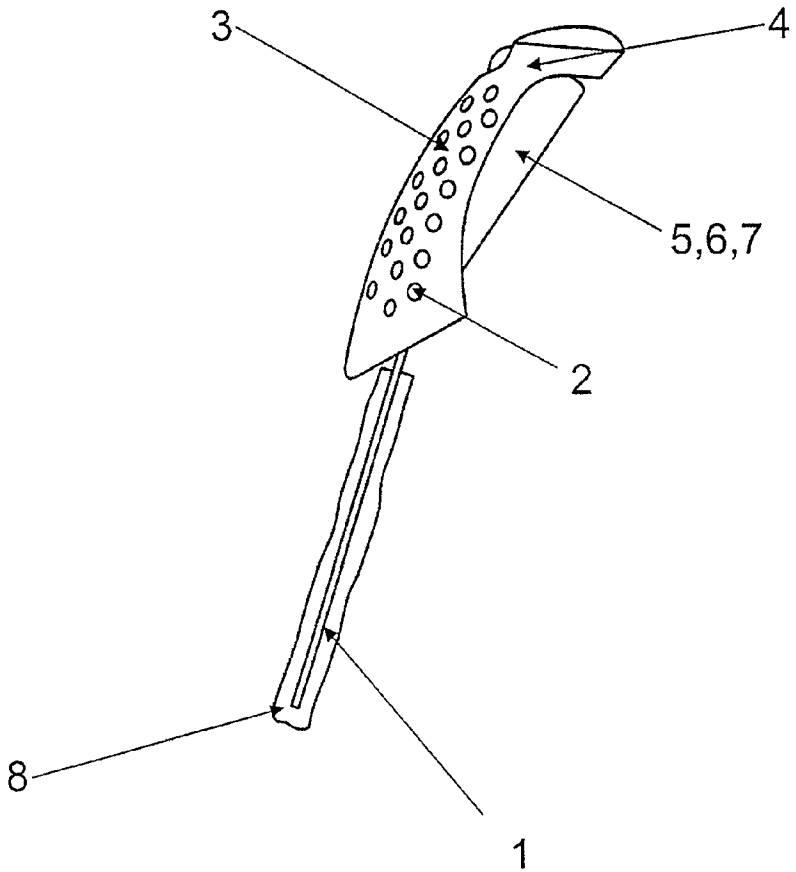
FIG. 4 is a side view of a second exemplary embodiment of a dust catcher according to the invention.

The manual handle 4 comprises a charging unit 5 and a discharging unit 6 in FIGS. 1-3. In FIG. 4, a combination unit 7 is provided in which both the charging unit 5 and the discharging unit 6 are arranged.

If the user grabs the electrostatic dust catcher, he actuates the charging unit, so as to produce an electric charge between the electrodes 1, 2, or the combination unit 7 and thus the charging unit 5. The charge remains as long as the charging unit 5/combination unit 7 is pressed.

Following the cleaning operation, the dust catcher charged with dust can be placed, for example, in a cleaning station. Then, the discharging unit 6 is actuated, or the combination unit 7 (and thus, the discharging unit 6) is actuated. The actuating can be done either by the user or automatically by placing the dust catcher in the cleaning station. In this way, a discharging takes place and the dust can be scraped off or knocked off the first electrode 1 without any problem. The dust catcher is again ready for use.

The invention claimed is:

1. An electrostatic dust catcher, comprising a first and a second electrode and a voltage source for applying an electric voltage between the two electrodes, wherein the first electrode comprises a dust-collecting device and the second electrode is grounded, wherein the voltage source comprises a battery with a starting voltage and a charging unit with a voltage divider and a bridge rectifier to convert the starting voltage into a high-frequency high voltage, wherein the high-frequency high voltage is converted, by a rectifier, into a static high voltage and is applied on a condenser.

2. A dust catcher according to claim 1, wherein the second electrode comprises a manual handle.

3. A dust catcher according to claim 2, wherein the voltage source is located in the manual handle.

4. A dust catcher according to claim 1, wherein the condenser has a capacity of 0.05-10 nF.

5. A dust catcher according to claim 1, wherein the condenser has a capacity of 1 nF.

6. A dust catcher according to claim 1, wherein the starting voltage is between 1.0 V and 10 V; the static high voltage is 0.5-10 kV.

7. A dust catcher according to claim 1, wherein the starting voltage is 1.5-3 V.

8. A dust catcher according to claim 1, wherein the static high voltage is adjustable.

9. A dust catcher according to claim 1, wherein the voltage source can be actuated by the charging unit.

10. A dust catcher according to claim 1, wherein the manual handle has a discharging unit for discharging the electric voltage between the electrodes.

11. A dust catcher according to claim 9, further including a discharging unit for discharging the electric voltage between the electrodes and wherein the charging unit and the discharging unit are configured in a combination unit.

12. A dust catcher according to claim 1, wherein the first electrode is at least partially covered by a dust cloth.

13. A dust catcher according to claim 1, wherein the first electrode is enclosed by a bag-shaped dust cloth.

14. A dust catcher according to claim 12, wherein the dust cloth consists, at least partially, of microfibers.

* * * * *